10/22/85 XR 4,548,378

United States Patent [19]

Worrallo

[11] Patent Number: 4,548,378

[45] Date of Patent: Oct. 22, 1985

[54] DISPLAY AND SHELF SUPPORT BRACKET AND THE LIKE

[76] Inventor: Anthony C. Worrallo, Private Bag, Onehunga, Auckland 6, New Zealand

[21] Appl. No.: 361,988

[22] Filed: Mar. 25, 1982

[51] Int. Cl.[4] ..... F16M 13/00

[52] U.S. Cl. ..... 248/558; 248/242; 248/245; 248/297.2

[58] Field of Search ..... 248/558, 242, 245, 244, 248/297.2, 207, 295.1; 403/297, 289, 254, 121; 211/162, 46, 94, 4, 205, 1

[56] References Cited

U.S. PATENT DOCUMENTS

| | | | |
|---|---|---|---|
| 723,677 | 3/1903 | Kade | 248/245 |
| 2,015,845 | 10/1935 | Elson | 248/207 |
| 2,451,110 | 10/1948 | Newman | 211/94 |
| 2,588,110 | 3/1952 | Halliday | 211/4 |
| 4,207,014 | 6/1980 | Worrallo . | |
| 4,351,441 | 9/1982 | Schramm | 211/205 X |

FOREIGN PATENT DOCUMENTS

| | | |
|---|---|---|
| 951322 | 3/1964 | United Kingdom . |
| 1137675 | 12/1968 | United Kingdom . |
| 1425603 | 2/1976 | United Kingdom . |

*Primary Examiner*—J. Franklin Foss
*Assistant Examiner*—David L. Talbott
*Attorney, Agent, or Firm*—Roylance, Abrams, Berdo & Goodman

[57] ABSTRACT

A shelf and display structure in which horizontal or sloping members (16, 18, 20) are mounted on a vertical element (12) by locking structures (14.1, 14.2, 14.3). Each locking structure includes a pair of arms (28) which are generally triangular in side elevation. Each arm has three grooves in the outer face thereof. The inner face of each arm is generally flat and merges at one end with a rolling surface. When two arms are placed in co-operating relationship with their rolling surfaces in contact, the arms diverge from one another. In this condition they can be inserted into an elongate mouth of the element (12) and the outer ends of the arms can then be pressed towards one another, the arms rolling on their rolling surfaces until the flat rear faces are juxtaposed. During such rolling motion the element 12 is deformed by the arms so that frictional forces are created which resist movement of the locking structures along the element (12). A horizontal member (16) or sloping members (18, 20) can be mounted on the arms by co-operation between these members and either the horizontal or the sloping grooves. Knobs, hooks or other devices can be mounted on the members (16, 18, 20) to enable articles to be displayed or, where the member is horizontal, it can support shelves.

16 Claims, 13 Drawing Figures

DISPLAY AND SHELF SUPPORT BRACKET AND THE LIKE

This invention relates to shelf and display structures.

According to one aspect of the present invention there is provided a structure comprising first and second elements and a pair of arms, the first element including two spaced apart portions which together define a mouth, and each arm having a first face and an opposed second face, there being a first groove in each first face adjacent one end thereof which grooves receive said portions when the arms are located in said mouth with the second of said opposed faces thereof in juxtaposed relationship, the distance between the bottom surfaces of said first grooves being greater than the width of said mouth between said portions before insertion of the arms therein so that said arms hold said portions apart, said one end of each arm being bounded by a rolling surface which merges with said second face, said rolling surfaces enabling said arms to roll one on the other between a position in which said second surfaces are in juxtaposed relationship and a position in which said rolling surfaces are in engagement with said arms diverging from said one end, said arms being inserted into and removed from said mouth while in this diverging relationship, second and third grooves in each first face, the second and third grooves of each first face being oblique with respect to one another and said second element including formations which can slide into the two second grooves or the two third grooves to prevent said arms moving to said diverging relationship.

Said second element is preferably in the form of a channel having a web and two flanges at right angles to said web, said formations being lips extending along the free edges of the flanges and defining an elongate mouth affording access to the elongate internal cavity of the second element.

Each arm can be generally triangular in form, the first, second and third grooves of each arm each extending parallel to and inwardly of a respective edge of the arm. In this form each arm cam include upstanding pairs of ribs on said first faces, each pair of ribs bounding one of said grooves.

The present invention also provides a display structure comprising first and second elements, a pair of arms and a plurality of display members, the first element including two spaced apart portions which together define a mouth, and each arm having a first face and an opposed second face, there being a transverse groove in each of said first faces adjacent one end thereof which grooves receive said portions when the arms are located in said mouth with the second of said opposed faces thereof in juxtaposed relationship, the distance between the bottom surfaces of said grooves being greater than the width of said mouth between said portions before insertion of the arms therein so that said arms hold said portions apart, said one end of each arm being bounded by a rolling surface which merges with said second face of that arm, said rolling surfaces enabling said arms to roll one on the other between a position in which said second surfaces are in juxtaposed relationship and a position in which said rolling surfaces are in engagement with said arms diverging from said one end, said arms being inserted into and removed from said mouth while in this diverging relationship, said second element having an elongate internal cavity with a slot-like elongate entrance affording access to said cavity and said second element being attachable to the arms to prevent the arms from moving to said diverging relationship, said display members being receivable in said cavity by insertion into one of the ends of the cavity and each display member including a portion which protrudes from the cavity through said slot-like entrance.

In one form of this display structure each display member includes a slide receivable in said cavity and each protruding portion is in the form of a ball. In another form of display structure each display member includes a slide receivable in said cavity and each protruding portion is in the form of a hook. Said hooks can be shaped so as to abut one another when a series of them are inserted in said cavity, each cooperating pair of hooks forming a transverse aperture which is closed on all four sides.

The slot-like entrance of the second element is preferably bounded by lips which protrude towards one another from flanges of said second element.

In one constructional form said second element is generally H-shaped in cross-section and comprises two flanges and a cross-bar, there being an elongate internal cavity on each side of said cross-bar, and there being elongate slot-like entrances affording access to said cavities, each entrance being bounded by lips which protrude towards one another from said flanges.

The arms of the display structure can each have second and third grooves in each first face, the second and third grooves of each first face being oblique with respect to one another and said second element including formations which can slide into the two second grooves or the two third grooves to prevent said arms moving to said diverging relationship.

For a better understanding of the present invention reference will now be made, by way of example, to the accompanying drawings in which.

Figure 1:
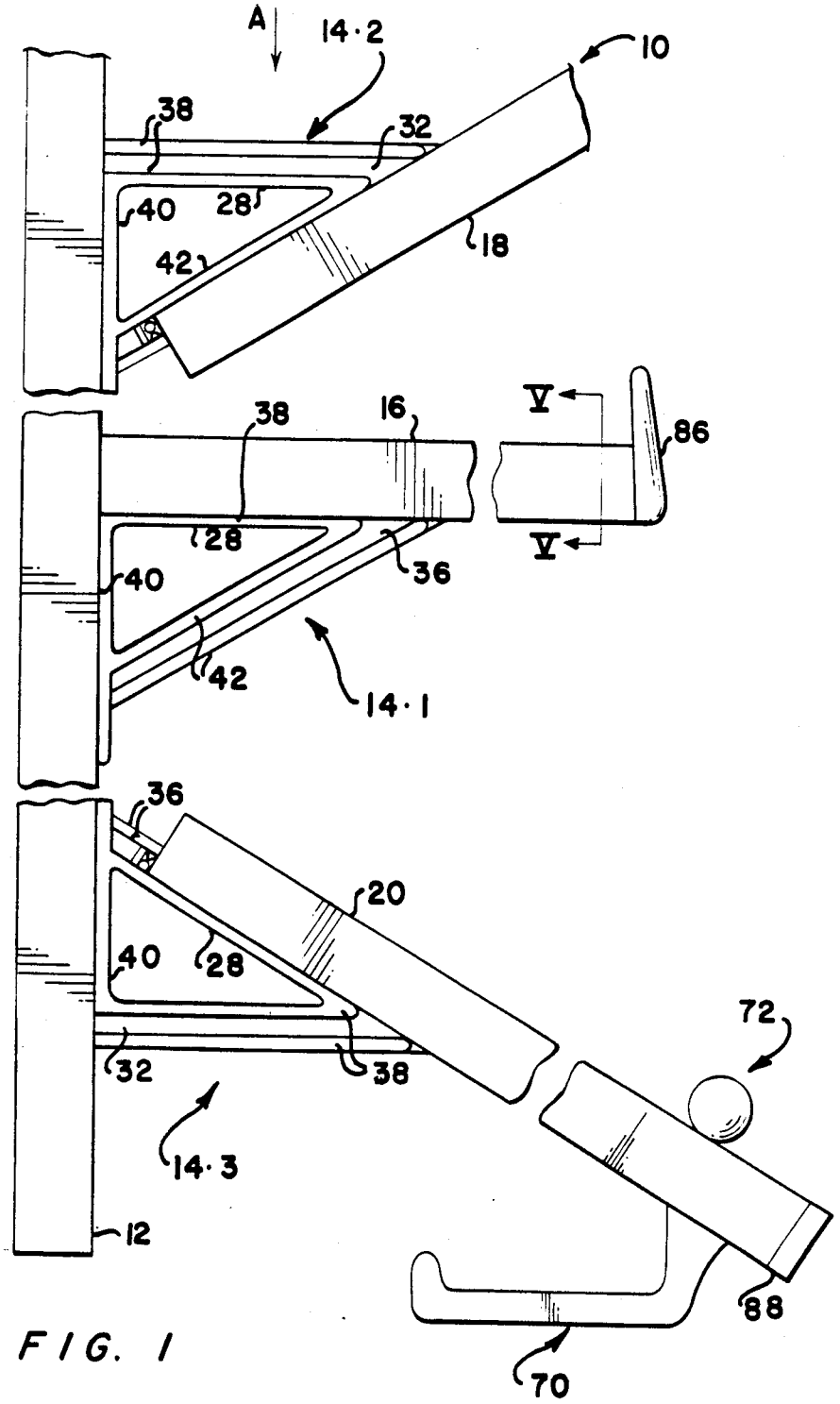
FIG. 1 is a side elevation of a shelf and display structure.

Referring first to FIGS. 1 to 5, the shelf and display structure 10 illustrated comprises a vertical element 12, a plurality of locking arrangements 14.1, 14.2 and 14.3, a horizontal support member 16 and two sloping support members 18 and 20. The members 16, 18 and 20 will not necessarily be used in the same shelf and display structure as one another and, for example, it would be more likely for there to be a series of horizontal support members 16 or a series of upwardly sloping support members 18 or a series of downwardly sloping support members 20. All three types of support member have been shown in conjunction with a single element 12 purely for the sake of illustration.

The element 12 can be in the form of an extrusion and comprises (see FIG. 2) a web 22 and a pair of parallel, spaced flanges 24. The free extremities of the flanges 24 have lips 26 therealong which are directed towards one another and which bound the mouth leading to the internal cavity of the element 12.

Each locking arrangement 14.1, 14.2 and 14.3 comprises two arms 28 (see particularly FIGS. 3 and 4) which in side elevation are of triangular form. Each arm 28 has a flat inner face 30 and an outer face which is formed with three grooves 32, 34 and 36. The groove 32 is bounded by two ribs 38, the groove 34 is bounded by two ribs 40 and the groove 36 is bounded by two ribs 42. It will be noted that the groove 32 intersects both the groove 34 and the groove 36 and that part of one of the ribs 40 forms an end wall of the groove 36. Each arm 28 has, at one end thereof, a curved face 44 which merges smoothly with the face 30 and also merges with the bounding surface of the outermost rib 40.

One of each pair of arms 28 is formed with small protrusions and the other of each pair of arms has matching depressions. The matching depressions and protrusions indicated at 46 (see particularly FIG. 2) prevent the arms 28 slipping with respect to one another while they are parallel with the faces 30 in contact. The matching protrusions and depressions indicated 48 and 50 only come into co-operating relationship during assembly or disassembly of the shelf and display structure (as will be described in more detail hereinafter) thus preventing relative vertical movement of these arms at this time.

Figure 2:
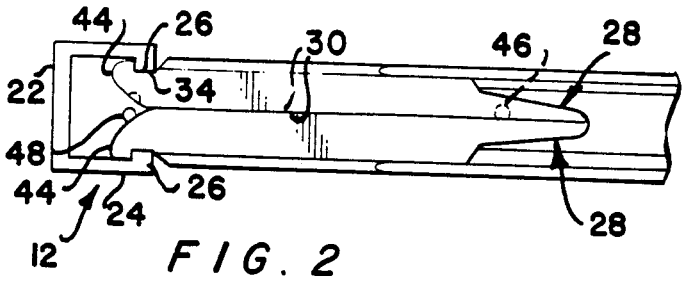
FIG. 2 is a top plan view taken in the direction of the arrow A in FIG. 1.
Figure 3:
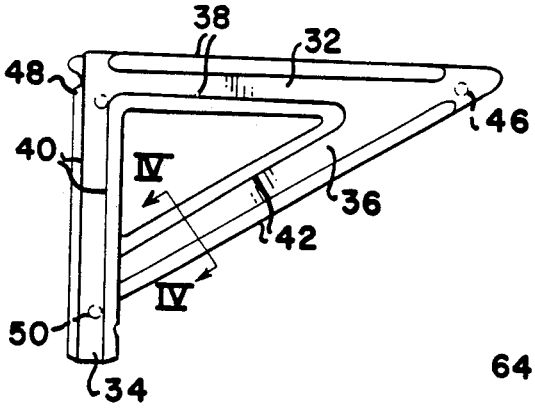
FIG. 3 is a side elevation of a locking arm.
Figure 4:
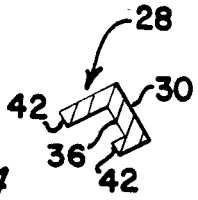
FIG. 4 is a section on the line IV—IV of FIG. 4.
Figure 5:
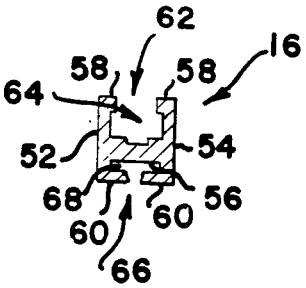
FIG. 5 is a section on the line V—V of FIG. 1.

The cross sectional shape of the groove 36 is illustrated in FIG. 4 (this also being the cross sectional shape of the groove 32) and the cross sectional shape of the groove 34 is best seen in FIG. 2. It will be noted that in the case of the ribs 38 and 42, one rib of each pair is larger than the other.

The horizontal member 16 is generally H-shaped in cross-section (see FIG. 5) and comprises two flanges 52 and 54 and a cross bar 56. The cross bar 56 is not centrally located with respect to the flanges 52 and 54 so that each flange projects further beyond the cross bar of one side thereof than on the other. Opposed lips 58 extend along two of the free edges of the flanges 52 and 54 and larger lips 60 extend along the other two free edges of the flanges 52 and 54. The lips 58 bound a slot-like mouth 62 leading to an elongate cavity 64 within the member 18. Likewise, the lips 60 form a slot-like mouth 66 leading into a second elongate cavity 68 within the member 18. It will be noted that the cavity 64 is substantially square in cross section and that the cavity 68 is narrow and slit-like. The lips 60 are shaped as shown for a purpose to be described. The members 18 and 20 are of the same cross-section as the member 16.

To assemble one of the locking arrangements 14.1, 14.2 or 14.3, the two arms 28 are placed back-to-back in a diverging relationship with the matching protrusions and depressions 48 and 50 in engagement. In this condition the effective width of the two arms 28 measured across the outermost of the ribs 40 is less than the width of the mouth bounded by the lips 26. The arms 28 thus enter the elongated cavity of the element 12 and the outer ends of the arms 28 are then pressed towards one another, the faces 44 rolling on one another during this movement. Once the faces 30 are juxtaposed, one of the members 16, 18 or 20 is used to hold the arms together, the lips 58 entering the grooves 32 in the case of a horizontal support member 16 or the grooves 36 in the case of a sloping support member 18 or 20. It will be understood that the outermost ribs of the pairs of ribs 42 in the case of a sloping member 18 or 20 and the outermost ribs of the pairs of ribs 38 in the case of a horizontal member together with the adjacent parts of the arms 28 enter the cavity 64.

The distance between the lips 26 (when the element 12 is undeformed) is less than the effective width of the pair of arms 28 (measured between the flat floors of the grooves 34) when they are in the condition shown in FIG. 2. Thus as the arms 28 are brought into their parallel relationship, the element 12 is deformed. More specifically, the flanges 24 are forced apart somewhat, this resulting in the lips 26 tightly gripping the arms 28. Any force tending to displace the locking arrangements 14.1, 14.2 or 14.3 along the element 12 is thus resisted by frictional contact between the lips 26 and the arms 28.

In FIG. 1 there is shown a hook 70 and a knob 72. While these are illustrated in conjunction with the member 20 it will be understood that they can if desired also be associated with the members 16 and 18. It will also be understood that only part of the length of each member 16, 18 and 20 has been shown and that, in practice, there will be a series of hooks 70 and/or a series of knobs 72 associated with each member.

Figure 6:
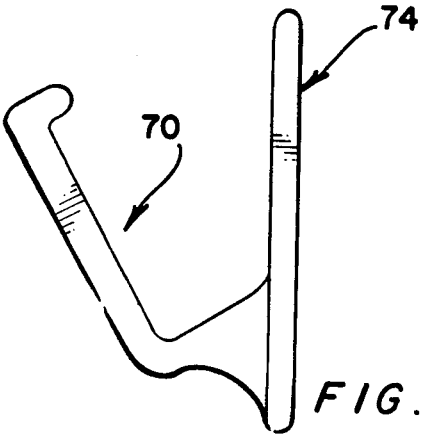
FIG. 6 is a side elevation of a hook.
Figure 7:
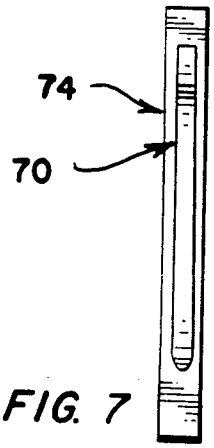
FIG. 7 is a front elevation of the hook of FIG. 6.
Figure 8:
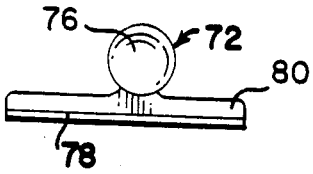
FIG. 8 is a side elevation of a knob structure.

Each hook 70 (see FIGS. 6 and 7) is cast integrally with a slide 74. The cross sectional shape of the slide 74 matches that of the cavity 64. Thus to mount a hook on the member 20, the slide 74 is inserted into that end of the cavity 64 which is remote from the element 12 and pushed along the member 20 to the desired position.

The knob 72 is constituted by a ball 76 cast integrally with a slide 78. The cross sectional shape of the slide 78 is such as to be compatible with cavity 68. A series of knobs 72 can be mounted on the member 20 by inserting the slides 78 into the cavity 68 from the end thereof remote from the element 12. It will be noted that the slide 78 includes a rib 80, the rib 80 being dimensioned so to fit in the elongate mouth 66.

Figure 9:
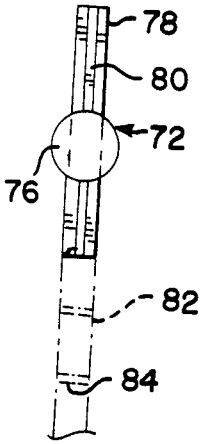
FIG. 9 is a top plan view of the structure of FIG. 8.
Figure 10:
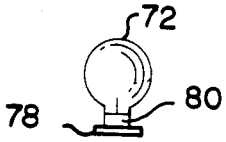
FIG. 10 is an end elevation of the structure of FIGS. 8 and 9.

In order to achieve the desired spacing between the knobs 72, the slide 74 can initially include a portion 82 shown in chain dotted lines in FIG. 9. The portion 82 is formed with a series of transverse weakening lines 84. By cutting or otherwise breaking the portion 82 along one of the weakened lines 84, the effective length of the slide 78 can be reduced thereby to decrease the spacing between adjacent knobs 72.

To cover and improve the appearance of the members 16, 18 and 20, end pieces of any suitable form can be used. Thus, in FIG. 1, an end piece 86 is shown in conjunction with the member 16. The end piece 86 is generally L-shaped and includes a portion the cross section of which is such as to enable it to slide into one of the cavities 64 or 68. The end piece 86 is a push fit in the respective cavity so that, while it can readily be removed, it will not be detached accidentally. In FIG. 1 a further end piece 88 is shown fitted to the member 20. This end piece is in the form of a plug having a generally rectangular head from which a spigot protrudes. The spigot is of a cross sectional shape which is compatible with one of the cavities 64, 68, preferably the larger cavity 64.

Figure 11:
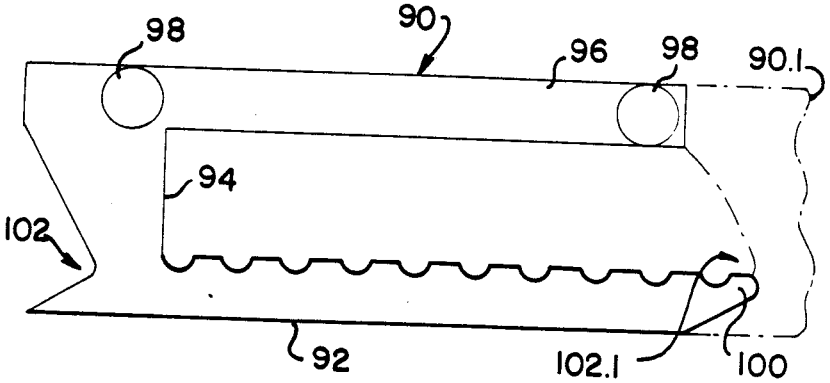
FIG. 11 is a side elevation of a further hook structure.
Figure 12:
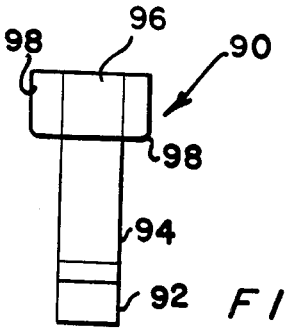
FIG. 12 is an end view of one of the hooks of the hook structure of FIG. 11.

In FIGS. 11 and 12 there is illustrated a modified form of hook, this hook being designated 90. The hook 90 includes a grooved bar 92 mounted by way of a column 94 on a slide 96. Two bosses 98 protrude on each side of the slide 96, the width of the slide measured across the bosses, and the cross sectional dimensions of the bosses being such that the slide 96 can be entered in the cavity 64. The provision of the bosses 98 reduces the area over which frictional contact between the slide and the bounding surfaces of the cavity 64 takes place.

The bar 92 is formed with a pointed nose 100 and the column 94 has a recess 102 therein.

To the right of the hook 90 shown, there is illustrated a part of a second hook 90.1. It will be seen that the nose 100 of the hook 90 enters the recess 102.1 and the slides 96 and 96.1 of the two hooks abut.

This particular form of hook is used by mounting a first hook 90 on one of the members 18, 20 or 22 and then hanging a handbag or the like on the bar 92. The next hook 90 of the series is then mounted on the member 16, 18 or 20 so that the two hooks abut as shown in FIG. 11. This then provides a transverse opening which is closed on all sides and within which the handle of the handbag is trapped. By mounting a series of hooks of this form, and then suitably locking in position the last hook of the series, a theft proof display arrangement can be provided. Locking of the hooks in place can be achieved by means of a transverse hole in the respective member 16, 18 or 20 with some form of key operated or combination operated lock passed through the transverse hole.

Figure 13:
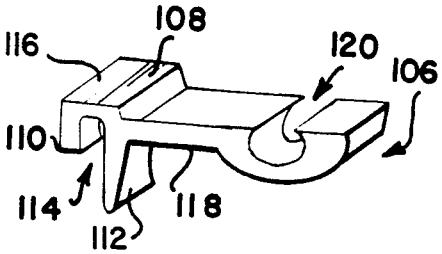
FIG. 13 is a pictorial view of a shelf support.

Turning finally to FIG. 13 a die cast or extruded shelf support 106 is shown which includes a horizontal web 108, a short depending flange 110 and a longer depending flange 112. The web 108 and flanges 110, 112 define a channel 114. A lip 116 extends along the inner face of the flange 110 and the shape of the components of the support 106 thus far described are such that the upper part of one of the flanges 52, 54 and one of the lips 60 (see FIG. 5) will enter the channel 114. Engagement between the lip 116 and the shaped lip 60 prevents disengagement of the support 106 from the member 16 except by sliding movement to the end of the member 16.

A support arm 118 protrudes from the flange 112 and is formed in its outer end with an upwardly open groove 120. This groove serves to receive a resilient strip (not shown). Shelves (not shown) rest on the resilient strips which are inserted in the grooves 120.

The element 12 is intended to be secured to a wall or other vertical surface. The element 12 can, however, be replaced by a free standing pole which has a series of pairs of lips 26 and a series of internal cavities. Thus members 16, 18 and 20 can be positioned so as to protrude radially in a number of different directions from the free standing pole.

I claim:

1. A structure, comprising;

a first element having two spaced apart portions defining a mouth therebetween with a first normal width between said portions;

first and second arms, each of said arms having opposite first and second faces, each of said first faces having a first groove adjacent a first end thereof to receive said portions when said arms are located in said mouth and when said second faces are juxtaposed, said first grooves having bottom surfaces spaced by a distance greater than said first width such that said arms force said portions apart when said second faces are juxtaposed, said first end of each of said arms being bounded by a rolling surface merging with said second face thereof, said rolling surfaces enabling said arms to roll on each other between a locking position in which said second faces are juxtaposed and a release position in which said rolling surfaces are engaged and said arms diverge from said first ends, said arms being inserted into and removed from said mouth in said release position, each of said first faces also having a second groove; and a second element including formations slideable into said second grooves to maintain said arms in said locking position.

2. A structure according to claim 1, wherein said second element comprises a channel having a web and two flanges at right angles to said web, said formations being lips extending along free edges of said flanges and defining an elongated second mouth affording access to an elongated internal cavity of the said second element.

3. A structure according to claim 2 wherein each of said first faces comprises a third groove; said first, second and third grooves on each of said arms are angularly oriented relative to one another; and said second element is slideably engageable with one of said second grooves and said third grooves to maintain said arms in said locking position.

4. A structure according to claim 1 wherein each of said first faces comprises a third groove; said first, second and third grooves on each of said arms are angularly oriented relative to one another; and said second element is slideably engageable with one of said second grooves and said third grooves to maintain said arms in said locking position.

5. A structure according to claim 4 wherein each of said arms is generally triangular in form, the first, second and third grooves of each arm each extending parallel to and inwardly of a respective edge of the arm.

6. A structure according to claim 1 wherein each of said arms comprises upstanding pairs of ribs on said first faces, each pair of ribs bounding one of said grooves.

7. A structure according to claim 2 wherein each of said arm comprises upstanding pairs of ribs on said first faces, each pair of ribs bounding one of said grooves.

8. A structure according to claim 1 wherein said second faces have at least one mating projection and recess to prevent relative slipping in said juxtaposed position.

9. A structure according to claim 1 wherein said rolling surfaces have a mating projection and recess to prevent relative sliding therebetween.

10. A structure, comprising:

a first element having two spaced apart portions defining a mouth therebetween with a first normal width between said portions;

first and second arms, each of said arms having opposite first and second faces, each of said first faces having a first groove adjacent a first end thereof to receive said portions when said arms are located in said mouth and when said second faces are juxtaposed, said first grooves having bottom surfaces spaced by a distance greater than said first width such that said arms force said portions apart when said second faces are juxtaposed, said first end of each of said arms being bounded by a rolling surface merging with said second face thereof, said rolling surfaces enabling said arms to roll on each other between a locking position in which said second faces are juxtaposed and a release position in which said rolling surfaces are engaged and said arms diverge from said first ends, said arms being inserted into and removed from said mouth in said release position;

a second element attachable to said arms and slidable in a groove in said arms to maintain said arms in said locking position, said second element having a first elongated internal cavity with a first slot-like elongated entrance providing access to said cavity; and a plurality of display members receivable in said cavity by insertion into an end of said cavity, each of said display members having a protruding part extending from said cavity through said slot-like entrance.

11. A structure according to claim 10 wherein each said display member comprises a slide receivable in said cavity; and each said protruding part is a ball.

12. A structure according to claim 10 wherein each said display member comprises a slide receivable in said cavity; and each said protruding part is a hook.

13. A structure according to claim 12 wherein said hooks are shaped to abut one another when a series thereof are inserted in said cavity, each cooperating pair of said hooks forming a transverse aperture closed on all four sides.

14. A structure according to claim 10 wherein said second elements comprise flanges and lips extending from said flanges toward one another, said lips defining said slot-like entrance.

15. A structure according to claim 10 wherein said second element is generally H-shaped in transverse cross-section and comprises two flanges and a cross-bar defining said first elongated cavity and a second elongated internal cavity on opposite sides of said cross-bar, and a second elongated slot-like entrance affording access to said second cavity, each of said entrances being bounded by lips extending toward one another from said flanges.

16. A structure according to claim 10 wherein each of said first faces comprise second and third grooves, said second and third grooves of each said first face being angularly oriented to one another; and said second element comprises formations slideable into one of said second grooves and said third grooves to maintain said arms in said locking position.

* * * * *